US008217587B2

(12) United States Patent
Sauerlaender

(10) Patent No.: US 8,217,587 B2
(45) Date of Patent: Jul. 10, 2012

(54) LED DRIVER CIRCUIT

(75) Inventor: Georg Sauerlaender, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 576 days.

(21) Appl. No.: 12/162,372

(22) PCT Filed: Jan. 26, 2007

(86) PCT No.: PCT/IB2007/050279

§ 371 (c)(1),
(2), (4) Date: Jul. 28, 2008

(87) PCT Pub. No.: WO2007/088505

PCT Pub. Date: Aug. 9, 2007

(65) Prior Publication Data

US 2009/0021182 A1 Jan. 22, 2009

(30) Foreign Application Priority Data

Jan. 31, 2006 (EP) ..... 06101079

(51) Int. Cl.
*H05B 37/02* (2006.01)

(52) U.S. Cl. ..... 315/291; 315/297; 315/307

(58) Field of Classification Search ..... 315/224–225, 315/247, 291, 297, 307–308, 360
See application file for complete search history.

(56) References Cited

U.S. PATENT DOCUMENTS

| | | | | |
|---|---|---|---|---|
| 6,320,330 | B1 * | 11/2001 | Haavisto et al. | 315/291 |
| 6,396,217 | B1 * | 5/2002 | Weindorf | 315/169.1 |
| 6,618,031 | B1 | 9/2003 | Bohn, Jr. et al. | |
| 7,129,679 | B2 * | 10/2006 | Inaba et al. | 323/222 |
| 7,259,525 | B2 * | 8/2007 | Yang | 315/291 |
| 7,511,436 | B2 * | 3/2009 | Xu | 315/307 |
| 7,602,305 | B2 * | 10/2009 | Lindsay et al. | 340/642 |
| 2002/0044004 | A1 * | 4/2002 | Guido et al. | 327/465 |
| 2003/0227265 | A1 * | 12/2003 | Biebl | 315/291 |
| 2004/0066154 | A1 | 4/2004 | Ito et al. | |
| 2005/0231133 | A1 | 10/2005 | Lys | |
| 2006/0022607 | A1 * | 2/2006 | Hsu | 315/209 R |
| 2007/0114951 | A1 * | 5/2007 | Tsen et al. | 315/291 |

FOREIGN PATENT DOCUMENTS

| | | | |
|---|---|---|---|
| GB | 2087604 | A | 5/1982 |
| WO | 2004100614 | A1 | 11/2004 |
| WO | 2007011932 | A1 | 1/2007 |

* cited by examiner

*Primary Examiner* — Tung X Le
(74) *Attorney, Agent, or Firm* — William S. Francos; Mark L. Beloborodov

(57) ABSTRACT

The present invention relates to a low cost LED driver module comprising a switched-mode power supply (smps) having down-converting characteristics (11) which is controlled by a comparator (31). The comparator is hysteresis configured, which reduces ripple and transients in the LED current, and the module can be accomplished with inexpensive standard components.

6 Claims, 2 Drawing Sheets

LED DRIVER CIRCUIT

The present invention relates to a LED (Light Emitting Diode) driver circuit, comprising a supply voltage input terminal, a control input terminal and first and second output terminals for connecting the driver circuit to at least one LED.

Such a LED driver circuit is described e.g. in US 2003/0227265 A1. Such LED driver circuits are usually made with dedicated LED driver integrated circuits (ICs) which may be very flexible and accurate.

However, such ICs are usually quite expensive, which renders a LED lighting device with good precision less competitive as compared to other lighting concepts.

An object of the present invention is therefore to provide a less expensive, but still very accurate, LED driver circuit of the kind mentioned above.

This object is achieved by means of a LED driver circuit as defined in claim 1.

More specifically, the LED driver then comprises a switched-mode power supply (smps) having down-converting characteristics, connected between the supply input terminal and the first output terminal, the said smps being controlled by a hysteresis-configured comparator circuit in order to regulate the LED current, and the switching levels of the comparator being set by a voltage reference, received at a reference terminal. Such a LED driver may be achieved using only simple standard components that have been available for decades, and can therefore be obtained at low cost. Moreover, a number of such LED drivers may share the same voltage reference, which makes the driver even more cost effective.

The control input terminal may be connected to a switch, enabling or disabling the output of the comparator circuit. This is an efficient way of achieving accurate PWM control of the LED output.

Alternatively, the control input terminal may be connected to a switch that affects a voltage divider network in the comparator circuit. This provides a less complex way of controlling the driver if only a limited number of output levels is needed.

A shunt resistor may receive a LED current in order to establish a corresponding voltage, which is fed to the comparator circuit. This provides a simple feedback arrangement. This corresponding voltage may be fed to the comparator circuit via a low-pass filter. This avoids the feedback arrangement being affected by switching noise.

The switched-mode power supply (smps) having down-converting characteristics may be a converter known in the art as a down-converter, step-down-converter or buck-converter.

These and other aspects of the invention will be apparent from and elucidated with reference to the embodiments described hereinafter.

Figure 1:
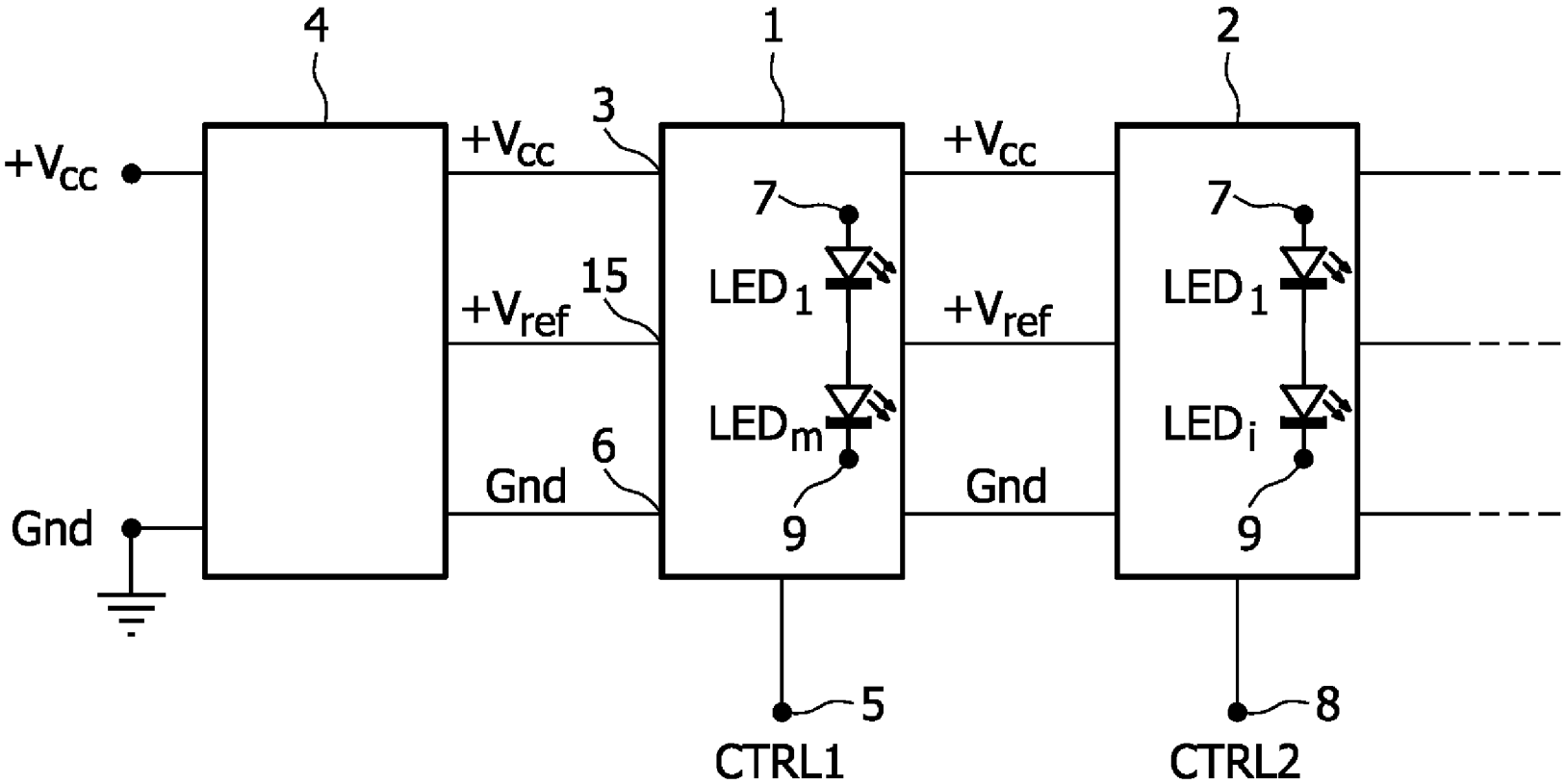
FIG. 1 illustrates schematically a set of LED driver circuits.

FIG. 1 illustrates schematically a set of two LED driver circuits 1, 2, connected to a common reference block 4. This arrangement is, however, scalable to include virtually any number of LED driver circuits. It has thus been considered to provide e.g. three driver circuits for an RGB (red-green-blue) arrangement or four driver circuits for an RGBA (red-green-blue-amber) arrangement. By controlling the light flow of each LED or string of LEDs in such an arrangement, virtually any color can be produced. Of course, other multi-color arrangements are conceivable, e.g. CMY (cyan-magenta-yellow). It is also possible to provide e.g. many RGB units in one arrangement.

The common reference block is arranged to output a supply voltage $+V_{cc}$, a reference voltage $+V_{ref}$ and a ground connection Gnd. The reference voltage $+V_{ref}$ may be provided e.g. using a bandgap reference based voltage regulator, such as the TL431.

The driver circuits each comprise a supply terminal 3, where the supply voltage $+V_{cc}$ is input, a reference terminal 15, receiving the reference voltage $+V_{ref}$, and a ground terminal 6. Each driver circuit 1, 2 further comprises a control terminal 5, 8, each receiving a control signal CTRL1, CTRL2, respectively. The control signals control the light flow output from the LEDs connected to each circuit.

Each of the driver circuits may drive one LED or a plurality of LEDs connected in series. If a plurality of diodes connected in series are used, their total voltage drop should be smaller than the supply voltage $+V_{cc}$.

As illustrated, the supply voltage and ground terminals, as well as the voltage reference terminals may be daisy-chained to a number of subsequent units, e.g. RGB units.

Figure 2:
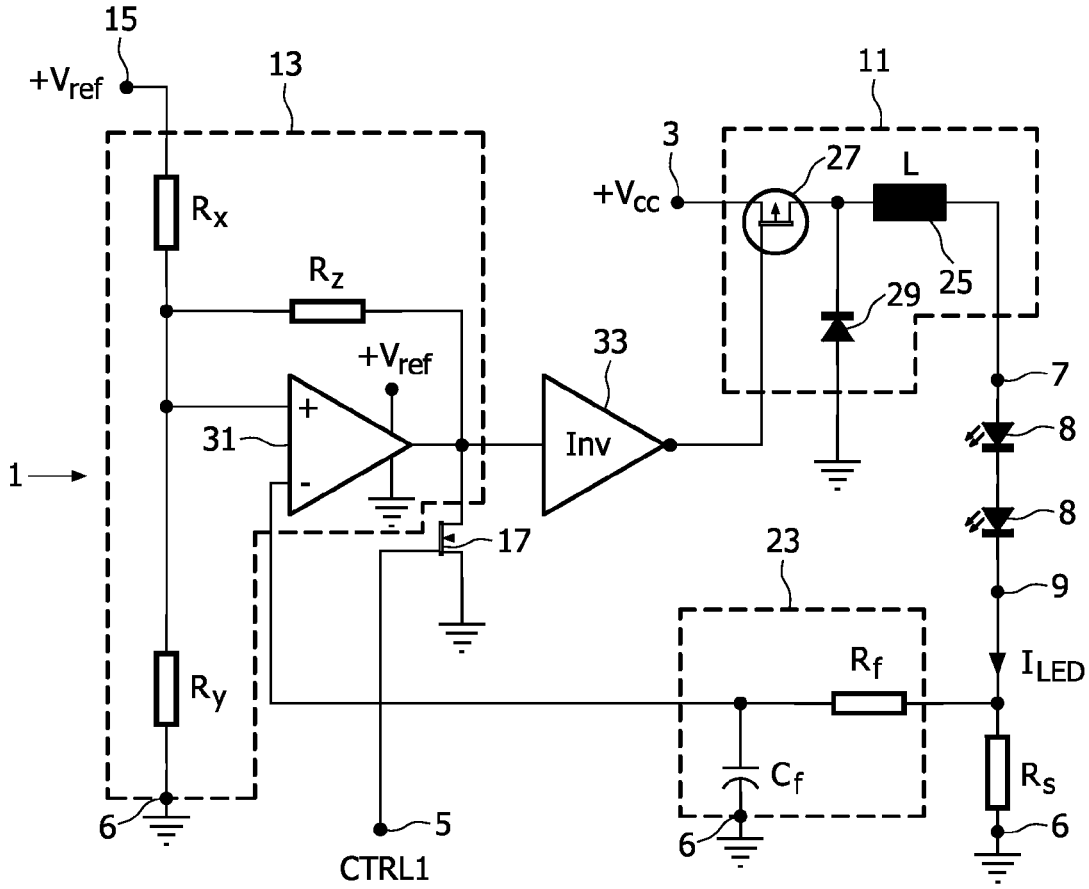
FIG. 2 shows a LED driver circuit according to an embodiment of the invention.

FIG. 2 shows a LED driver circuit 1 according to an embodiment of the invention. This circuit has a first 7 and a second 9 output terminal, and two LEDs 8 are series connected between these terminals.

The first output terminal 7 is connected to the supply input terminal 3 via a switched-mode power supply (smps) having down-converting characteristics 11, in this case a so-called buck- or (step-)down-converter. This converter comprises an inductor 25 connected in series to a switch 27, such as a p-MOSFET. The switch makes the current through the inductor ramp up and down, and a free-wheel diode 29 allows the inductor current to continue to flow when the switch is switched off. Needless to say, other switched-mode power supply (smps) topologies having down-converting characteristics can be used in a LED driver of the inventive kind, e.g. a flyback converter.

The second output terminal 9 is connected to ground via a shunt resistor $R_s$. The voltage drop over the shunt resistor corresponds to a measure of the current $I_{LED}$ fed through the LEDs powered by the LED driver circuit.

The smps 11 is controlled by a hysteresis configured comparator circuit 13. This circuit comprises a comparator 31, the inverting input (−) of which receives the LED current measure from the shunt resistor $R_s$, via a low-pass filter 23. The non-inverting input (+) of the comparator 31 is connected to a resistor network, comprising three resistors $R_x$, $R_y$ and $R_z$. $R_x$ is connected to the reference terminal 15, and is connected in series via $R_y$ to ground. The non-inverting input of the comparator 31 is connected to the mid-point between $R_x$ and $R_y$, and $R_z$ is connected between this point and the comparator output. The comparator output drives the switch 27 of the smps 11 via an inverter 33, such that the switch 27 is in its ON state allowing the LED current to build up when the voltage difference between the non-inverting terminal (+) and the inverting terminal (−) of the comparator is positive. With a different choice of switch 27, the inverter 33 is not needed.

The reference voltage $V_{ref}$, received at the reference terminal 15, sets the switching levels of the comparator. Thus, when the switch 27 is turned on, the current $I_{LED}$ through the LEDs is allowed to ramp up until the voltage at the negative comparator input reaches the transition voltage $V_{on}$, which is defined as:

$$V_{on} = \frac{R_y}{R_y + \frac{R_x \cdot R_z}{R_x + R_z}} \cdot V_{ref}$$

Then, the comparator output is switched to ground level, and the switch 27 is turned off. The LED current now decreases until the voltage at the negative comparator input reaches a second transition voltage $V_{off}$, defined as:

$$V_{off} = \frac{\frac{R_y \cdot R_z}{R_y + R_z}}{R_x + \frac{R_y \cdot R_z}{R_y + R_z}} \cdot V_{ref}$$

At this instant, the switch is turned on again, and a new cycle is begun in a self oscillating manner. $V_{off}$ is lower than $V_{on}$, and both the average LED current and the allowed ripple are set by $V_{ref}$, $R_x$, $R_y$, and $R_z$. Thanks to the hysteresis or bang-bang configuration, the LED current ripple as well as transients in the LED current can be kept down, which allow the LEDs to emit light with a well defined color and intensity.

The low-pass filter 23 may comprise a simple first order Butterworth filter, comprising a resistor $R_f$ and a capacitor $C_f$. Thanks to the low-pass filter, potential high-frequency noise of the switch 17, occurring when the switch is turned on or off, may be filtered out. This results in an almost noise-free triangular voltage, which represents the LED current $I_{LED}$, which is input at the inverting (−) comparator input.

The illustrated circuit can be accomplished at very low cost. Standard integrated circuits containing four comparators are available at low cost, allowing e.g. an RGBA unit to be achieved with only one chip and some simple additional components.

The light flow can be PWM (Pulse Width Modulation) controlled with a switch 17 (e.g. a MOSFET) at the output of the comparator 31. The gate of this switch 17 is connected to the control input terminal 5, and if the switch 17 is turned on, the comparator is connected to ground, and the driving circuit 1 is switched off. This makes it possible to PWM control the light flow from the LEDs by varying the duty cycle of the switch 17. Of course this is done with a switching frequency which is low, e.g. a few hundred Hz, as compared to the switching frequency of the down converter 11, which may be a few hundred kHz.

Figure 3:
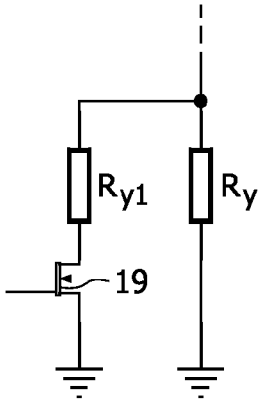
FIG. 3 shows a detail of a LED driver circuit in an alternative embodiment.

FIG. 3 shows a detail of a LED driver circuit in an alternative embodiment. In this embodiment, the switch 17 in FIG. 2 is not needed. Instead, the LED current may be changed by a switch 19 that connects an additional resistor $R_{y1}$ in parallel with the resistor $R_y$. As is evident from the equations above, this changes the transition levels $V_{on}$ and $V_{off}$. This control arrangement allows the average LED current to be changed to either of two values, which makes it less flexible than the PWM solution, but also less complex. In general in this embodiment, one or more switches are used, which affect a voltage divider network in the comparator circuit. If more than one switch is used, more than two non-zero LED current values are possible. The switch, or switches, may thus be applied to connect a resistor in parallel with one or more of the resistors $R_x$, $R_y$, and $R_z$. In principle, this embodiment can be combined with the PWM solution of FIG. 1.

In summary, the invention relates to a low cost LED driver module comprising a switched-mode power supply (smps) which has down-converting characteristics and is controlled by a comparator. The comparator is hysteresis configured, which reduces ripple and transients in the LED current, and the module can be accomplished with inexpensive standard components.

The invention is especially attractive for applications with multiple strings of LEDs, due to the fact that the voltage reference signal can be re-used and only a small number of additional components are needed to achieve an additional controllable LED driver circuit, and thus an additional LED channel, e.g. a couple of resistors and transistors, a comparator, a diode and an inductor.

The invention is not restricted to the described embodiments. It can be altered in various ways within the scope of the appended claims.

The invention claimed is:

1. A LED driver circuit comprising a supply voltage input terminal, a control input terminal and first and second output terminals for connecting the driver circuit to at least one LED, the LED driver circuit further comprising:

a switched-mode power supply having step-down converting characteristics connected between the supply input terminal and the first output terminal, the switched-mode power supply being controlled by a hysteresis configured comparator circuit in order to regulate the LED current, wherein switching levels of the comparator circuit are set by a voltage reference ($+V_{ref}$) received at a reference terminal.

2. A LED driver circuit according to claim 1, wherein the control input terminal is connected to a switch, enabling or disabling the output of the comparator circuit.

3. A LED driver circuit according to claim 1, wherein the control input terminal is connected to a switch, which affects a voltage divider network in the comparator circuit.

4. A LED driver circuit according to claim 1, wherein a shunt resistor ($R_s$) receives a LED current ($I_{LED}$) in order to establish a corresponding voltage, which is fed to the comparator circuit.

5. A LED driver circuit according to claim 4, wherein the voltage is fed to the comparator circuit via a low-pass filter.

6. A LED driver circuit according to claim 1, wherein the switched-mode power supply is a step-down converter or a buck-converter.

* * * * *